73-151 SR
1/26/88 XR 4,720,996

United States Patent [19]

Marsden et al.

[11] Patent Number: 4,720,996

[45] Date of Patent: Jan. 26, 1988

[54] POWER CONTROL SYSTEM FOR SUBSURFACE FORMATION TESTING APPARATUS

[75] Inventors: Michael J. Marsden, Houston; Dean C. Minehart, Sugarland, both of Tex.

[73] Assignee: Western Atlas International, Inc., Houston, Tex.

[21] Appl. No.: 818,528

[22] Filed: Jan. 10, 1986

[51] Int. Cl.[4] ..... E21B 49/00

[52] U.S. Cl. ..... 73/155; 73/151

[58] Field of Search ..... 73/151, 152, 155; 340/856; 307/1, 126, 131, 140, 141; 361/63, 65, 79, 87, 93, 94

[56] References Cited

U.S. PATENT DOCUMENTS

| | | | |
|---|---|---|---|
| 2,674,313 | 4/1954 | Chambers | 166/100 X |
| 2,802,200 | 8/1957 | Schafer et al. | 73/152 |
| 3,182,286 | 5/1965 | Zimmerman et al. | 340/856 |
| 3,459,955 | 8/1969 | Hurlbert | 340/856 |
| 3,780,575 | 12/1973 | Urbanosky | 73/152 |
| 4,178,579 | 12/1979 | McGibbeny et al. | 340/856 |
| 4,370,564 | 1/1983 | Matsushita | 307/140 |
| 4,434,653 | 3/1984 | Montgomery | 73/151 |
| 4,443,712 | 4/1984 | Gokita | 307/140 |
| 4,507,569 | 3/1985 | Hess, II | 307/140 X |
| 4,540,939 | 9/1985 | Osborne | 361/87 X |
| 4,543,493 | 9/1985 | Stanley et al. | 307/140 X |

*Primary Examiner*—Stewart J. Levy
*Assistant Examiner*—Scott M. Oldham
*Attorney, Agent, or Firm*—Patrick H. McCollum

[57] ABSTRACT

Apparatus for collecting a plurality of samples of fluids in earth formations traversed by a wellbore includes control circuits for supplying power control signals to the subsurface instrument. The control circuits include circuitry for establishing electrical connection to the hydraulic power system of the instrument and after a preselected period of delay supplying power signals to a hydraulic pump motor and/or solenoid valve controls therein. Current is monitored by over-current protection circuitry. In the instance of a current overload, power signals are removed from the hydraulic power system and after a preselected period of delay the control circuits are disconnected from the instrument.

8 Claims, 6 Drawing Figures

POWER CONTROL SYSTEM FOR SUBSURFACE FORMATION TESTING APPARATUS

BACKGROUND OF THE INVENTION

This invention relates, in general, to subsurface formation testing apparatus, and more particularly to power control methods and apparatus for controlling the performance of non-destructive collection of fluid samples from subsurface earth formations traversed by a borehole.

The sampling of fluids contained in subsurface earth formations provides a method of testing formation zones of possible interest by recovering a sample of any formation fluids present for later analysis at the earth's surface while causing a minimum of damage to the tested formations. Thus, the formation sampler is essentially a point test of the possible producibility of subsurface earth formations. Additionally, a continuous record of the sequence of events during the test is made at the surface. From this record valuable formation pressure and permeability data can be obtained for formation reservoir analysis.

Early formation fluid sampling instruments, such as the one described in U.S. Pat. No. 2,674,313, were not fully successful as a commercial service because they were limited to a single test on each trip into the borehole. Later instruments were suitable for multiple testing; however, the success of these testers depended to some extent on the characteristics of the particular formations to be tested. For example, where earth formations were unconsolidated a different sampling apparatus was required than in the case of consolidated formations.

One major problem which has hampered the reliable testing of subsurface earth formations has been designing a suitable system for controlling the operation of the downhole hydraulic system including numerous solenoid control valves. The typical subsurface formation testing instrument employed in obtaining samples includes a hydraulic power system, such system includes a hydraulic pump which is typically an electrically powered, rotary, positive displacement type hydraulic pump powered by 440 VAC. The hydraulic pump develops hydraulic fluid pressures which by means of solenoid control valves selectively controlled by surface power signals, are used to extend the sample admitting probe and a back-up well engaging pad member and to open fluid sample collection tanks. Examples of such systems can be found in U.S. Pat. Nos. 4,434,653 and 3,780,575. This downhole hydraulic power system represents a large inductive load to the surface power control system. This application of power control signals to the system can result in generating relatively large interference signals. Prior art attempts to eliminate this interference have included using grounded, shielded cable for power wiring and large capacitors for heavy filtering. Such efforts have proven less than totally successful.

Accordingly, the present invention overcomes the deficiencies of the prior art by providing method and apparatus for providing high voltage AC power control signals to the subsurface testing instrument eliminating power surges on the system control and measurements.

SUMMARY OF THE INVENTION

Apparatus for obtaining a plurality of formation fluid samples and subsurface measurements according to the present invention includes a fluid admitting member and a fluid sampling and measuring instrument. This instrument includes a hydraulic power system having a hydraulic pump and a plurality of solenoid control valves for controlling the application of hydraulic pressures to various elements of the instrument to facilitate obtaining samples of formation fluids. Control circuits located at the earth's surface supply power control signals to the hydraulic power system. The control circuits include circuits for establishing electrical communication between the subsurface instrument and power circuits and, after a preselected period of delay, supplying an alternating current power signal starting at the next zero crossing of the power signal to the pump motor and/or solenoid valves. In addition, current supplied by the power circuits is monitored by current monitoring circuits to assure that it remains within a preselected operating limit. Should current exceed the preselected operating limit an over-current protection circuit will automatically deactivate the power circuits and, after a preselected delay, decouple electrical communication between the subsurface instrument and the power circuits.

DETAILED DESCRIPTION OF THE PREFERRED EMBODIMENT

Figures 1, 2:
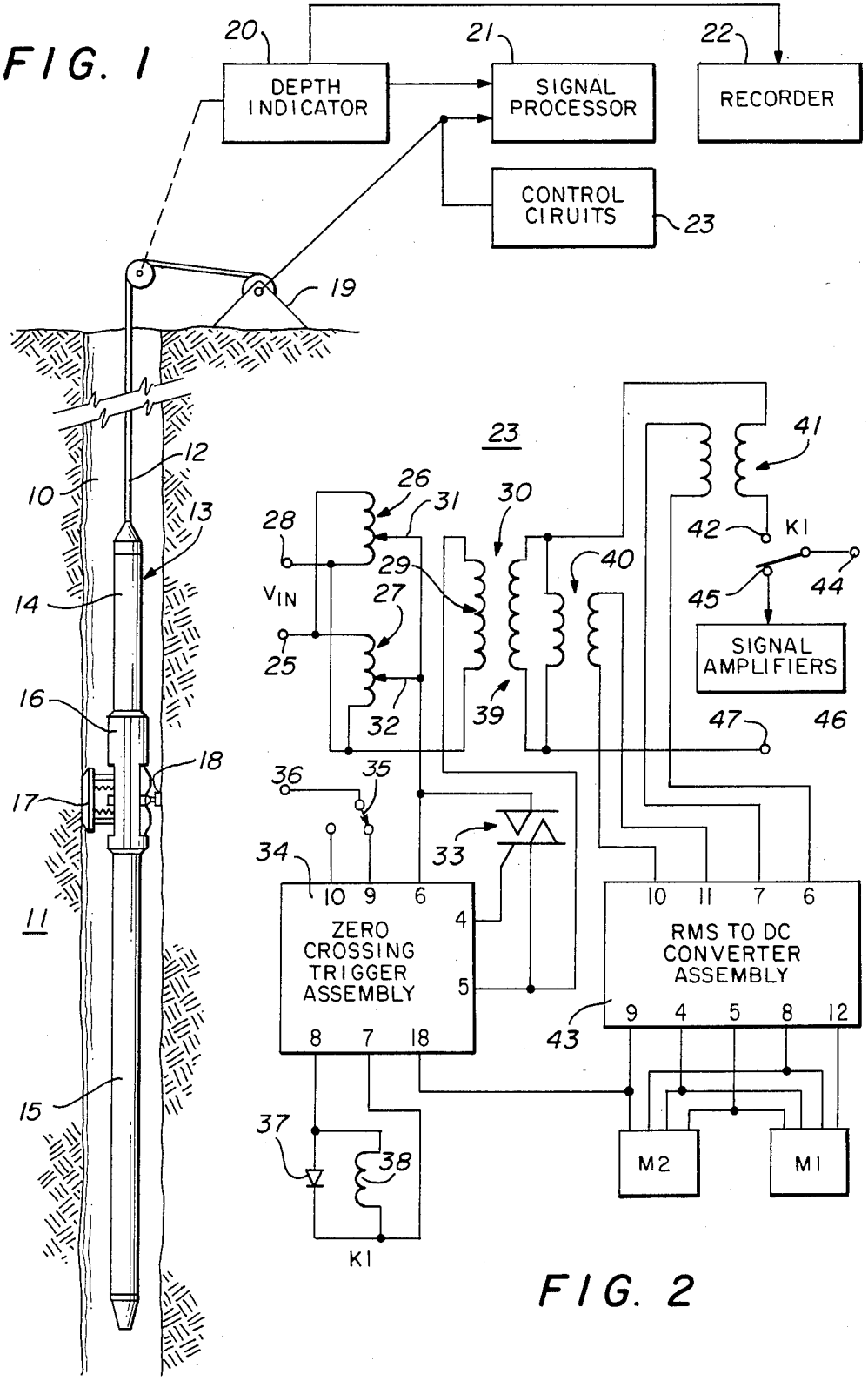
FIG. 1 is a pictorial view, partly in cross-section, of a formation test instrument disposed in a borehole and the surface located control and processing system.
FIG. 2 is a schematic diagram, partly in block form, of a portion of the surface control circuits.

Referring now to the drawings in more detail, particularly to FIG. 1, there is illustrated schematically a section of a borehole 10 penetrating a portion of the earth formations 11, shown in vertical section. Disposed within borehole 10 by means of a cable or wireline 12 is a sampling and measuring instrument 13. The sample and measuring instrument 13 is comprised of a hydraulic power system section 14, a fluid sample storage section 15 and a sampling mechanism section 16. Sample mechanism section 16 includes selectively extensible well engaging pad member 17 and a selectively extensible fluid admitting member 18.

In operation, sampling and measuring instrument 13 is positioned within borehole 10 by winding or unwinding cable 12 from hoist 19, around which cable 12 is spooled. Depth information from depth indicator 20 is coupled to signal processor 21 and recorder 22 when instrument 13 is disposed adjacent an earth formation of interest. Electrical control signals from control circuits 23 are transmitted through electrical conductors contained within cable 12 to instrument 13. These electrical control signals activate a hydraulic pump (not shown) within the hydraulic power system section 14 causing the well engaging pad member 17 and the fluid admitting member 18 to move laterally from instrument 13 into engagement with the earth formations 11. Fluid admitting member 18 can then be placed in fluid communication with the earth formations 11 by means of electrical control signals from control circuits 23 selectively activating solenoid valves (not shown) within instrument 13 for the taking of a sample of any producible connate fluids contained in the earth formations. These solenoid valves can be any suitable electrically controllable hydraulic control valves, such as those sold by ATKOMATIC VALVE COMPANY, under part number 15-885. A more complete description of the apparatus of instrument 13 can be found in U.S. Pat. No. 4,434,653 issued Mar. 6, 1984 to Marshall N. Montgomery and assigned to the assignee of the present invention, which is incorporated herein by reference.

Referring now to FIG. 2, there is illustrated partially in schematic view a portion of the control circuits 23 for applying relatively high voltage alternating current to the motor and assorted solenoid valves within subsurface instrument 13. Input terminal 25 is coupled to one side of the winding of Variac 26 and 27. Input terminal 28 is coupled to the second side of winding of Variac 26 and 27 and to one side of the primary winding 29 of high voltage step-up transformer 30. Wiper arms 31 and 32 of Variac 26 and 27 are connected to one side of traic 33 and terminal 6 of zero crossing trigger assembly 34. The second side of triac 33 is connected to terminal 5 of zero crossing and trigger assembly 34 and to the second side of primary winding 29 of transformer 30.

Zero crossing trigger assembly 34 terminal 10 is connected to the arm of on/off switch 35 in the "on"position, the arm of which is connected to a suitable power source at terminal 36. Terminal 8 of zero crossing trigger assembly 34 is connected to one side of diode 37 and electrical winding 38 of relay K1 the other side of which are connected to terminal 7. The gate of triac 33 is connected to terminal 4 of assembly 34.

Secondary winding 39 of transformer 30 is connected at one end to one side of the primary winding of transformer 40 and to output terminal 47 which is connected through electrical conductors in cable 12 to subsurface instrument 13. The other side of secondary winding 39 is connected to the other side of the primary winding of transformer 40 and to one side of the primary winding of transformer 41, the other side of which is connected to terminal 42 of relay K1. The contact arm of relay K1 is connected to output terminal 44 which is connected through electrical conductors in cable 12 to subsurface instrument 13. Terminal 45 of relay K1 is connected to input of signal amplifier circuits 46 for spontaneous potential and gamma ray signal processing.

One side of the secondary winding of transformer 40 is connected to terminal 10 of RMS to DC converter assembly 43, with the other side of secondary winding connected to terminal 11. The secondary winding of transformer 41 is connected between terminals 6 and 7 of converter assembly 43. Terminals 4, 5, 8, 9 and 12 of converter assembly 43 are connected to meters M1 and M2. In addition terminal 9 of converter assembly 43 is connected to terminal 18 of zero crossing trigger assembly 34.

Figure 3:
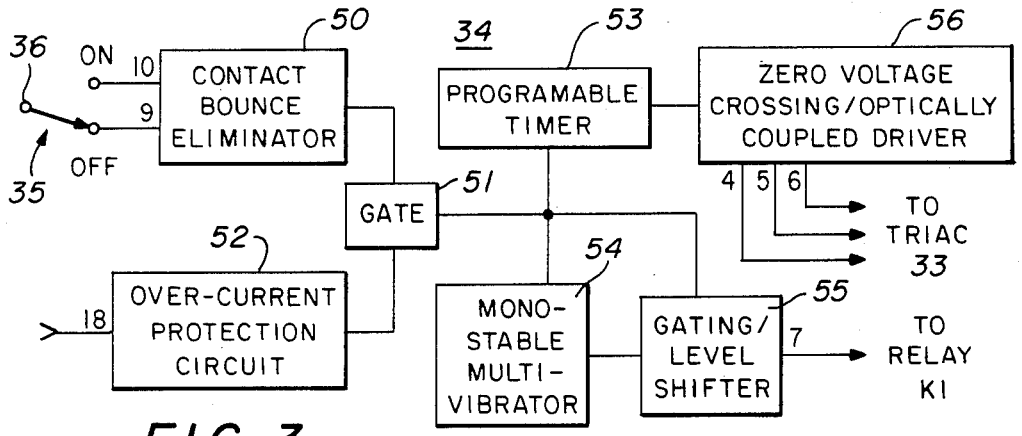
FIG. 3 is a block diagram of the zero crossing and trigger assembly shown in FIG. 2.

Referring now to FIG. 3, there is illustrated a block diagram view of the circuits of zero crossing trigger assembly 34. On/off switch 35 is connected to the input of contact bounce eliminator 50 the output of which is coupled to one input of gate 51. The second input to gate 51 is coupled to the output of over-current protection circuit 52, the input of which is connected to terminal 9 of RMS to DC converter assembly 43. The output of gate 51 is coupled into the input of programmable timer 53, monostable multivibrator 54 and one input of gating level shifter 55. The output of timer 53 is connected to the input of zero voltage crossing/optically coupled triac driver 56. The outputs 4, 5 and 6 from triac driver are connected to triac 33 of FIG. 2. The output of multivibrator 54 is coupled to the second input of gating level shifter 55 the output of which is connected to the winding of relay K1 and one side of diode 37.

Figure 4:
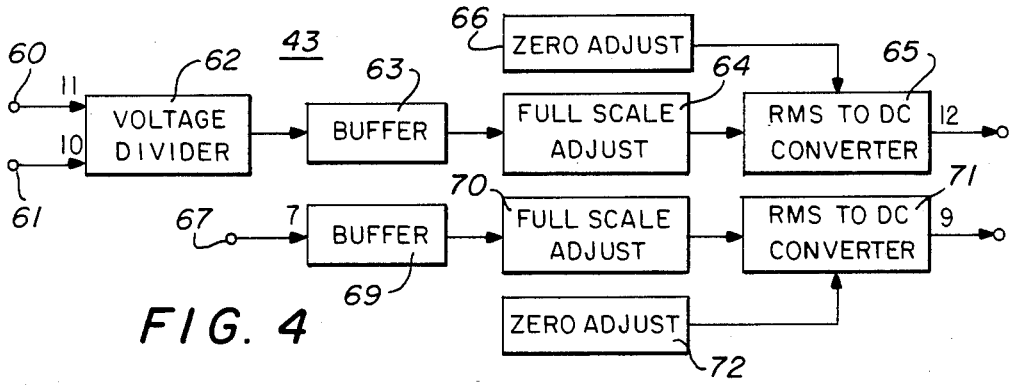
FIG. 4 is a block diagram of the RMS to DC converter assembly shown in FIG. 2.

Referring now to FIG. 4, there is illustrated a block diagram view of the circuits of RMS to DC converter assembly 43. Input terminals 60 and 61, connected to the secondary of transformer 40, provide inputs to voltage divider 62 the output of which is coupled to the input of buffer 63. The output of buffer 63 is connected to the input of full scale adjust circuit 64 the output of which connects to one input of RMS to DC converter 65 the other input of which connects to zero adjust circuit 66. The output of RMS to DC converter assembly is coupled to voltmeter M1.

Input terminal 67, connected to the secondary of transformer 41, provide inputs into buffer 69 the output of which is connected ot full scale adjust circuit 70. The output of full scale adjust circuit provides one input to RMS to DC converter 71 the other input being connected to the output of zero adjust circuit 72. The output of RMS to DC converter 71 is coupled to current meter M2 and to terminal 18 of over-current protection circuit 52.

In the operation of the control circuits illustrated in FIGS. 2, 3, and 4, an alternating current (AC) voltage Vin of 120 VAC is applied across input terminals 25 and 28 and thus across the windings of Variac 26 and 27. The output wiper arms 31 and 32 of Variac 26 and 27 are set to provide a control voltage at subsurface instrument 13 of 440 VAC. It should be recognized that in a non-conductory state, triac 33 will prevent voltage from being applied across primary 29 of transformer 30. In this mode of operation, the contact arm of relay K1 is connected to terminal 45 connecting surface signal amplifier 46 to subsurface instrument 13 by way of terminal 44 and electrical conductors in cable 12. To provide control power signals to the subsurface motor and solenoid, switch 35 is shifted to the "on" position. Contact bounce eliminator 50 eliminates surges which may result from momentary contact breaks of switch 35. The output signal from contact bounce eliminator 50 causes the output of gate 51 to change states further causing gating/level shifter 55 to output a signal to energize relay K1 shifting the contact arm from terminal 45 to terminal 42, connecting the primary of transformer 41 to subsurface instrument 13.

The output of gate 51 is coupled simultaneously to the input of programmable 53. After a preselected delay, in the preferred embodiment 125 ms, the output of timer 53 will change states. This change of states is coupled into the input of zero voltage crossing/optically coupled triac driver 56. This circuit consists of gallium-arsenide infrared-emitting diodes optically coupled to monolithic silicon detectors performing the functions of a zero voltage crossing bilateral triac drivers. This circuit isolates the low voltage circuits from the high voltage circuits and functions to turn on triac 33 allowing it to conduct on a zero crossing of the alternating current line voltage Vin. Thus, on the first zero crossing of the alternating current line voltage Vin, after a preselected delay period, driver 56 will allow current to flow through the gate of triac 33 allowing triac 33 to conduct placing the alternating current signal voltage across primary 29 of transformer 30.

Transformer 30 is a 10:1 step up transformer having one side of its secondary 39 connected to one side of the primary of transformer 40 and output terminal 47. The other side of secondary 39 is connected to the junction of the primaries of transformer 40 and 41, the other side of which is connected to output terminal 44 through previously energized relay K1. Transformer 40 functions as a portion of a voltage measuring circuit. The secondary of transformer 40 is connected to voltage divider 62 which is a 9:1 voltage divider. The output of voltage divider is coupled through buffer 63 into RMS to DC convertor 65. Full scale adjust circuit 64 and zero adjust circuit 66 establish scale calibration for converter 65 the output of which is a voltage measurement signal displayed on meter M1.

Transformer 41 functions as a portion of a current measuring circuit. For two (2) amps rms in the output is two volts rms. The secondary of transformer 41 is connected through buffer 69 into RMS to DC converter 71. Full scale adjust circuit 70 and zero adjust circuit 72 establish scale calibration for converter 71. The output of converter 71 is a DC voltage signal proportional to the current supplied through cable 12 to instrument 13 and is coupled for display on meter M2 and to the input of over-current protection circuit 52.

Under normal operating conditions, control power signals are removed from instrument 13 by shifting switch 35 to the "off" position. The output of contact bounce eliminator 50 changes states causing a change of state in the output of gate 51 resetting timer 53 which turns off zero voltage crossing optically coupled driver 56. Thus, on the next zero crossing, when line current through triac 33 drops below the hold-in current, the triac shuts off removing voltage from primary 29 of transformer 30. Additionally, the output of gate 51 will trigger monostable multivibrator 54. After a preselected delay, in the preferred embodiment 220 ms, the output of multivibrator 54 will change states causing the output of gating/level shifter 55 to deenergize relay K1 causing the contact arm to shift to terminal 45, reconnecting signal amplifier 46 to instrument 13.

During the time control power signals are applied to instrument 13 current is measured by RMS to DC converter assembly 43. A voltage signal proportional to the current is coupled into over-current protection circuit 52 where it is compared to a preselected value, in the preferred embodiment 2.1 VDC. Should the current drawn by instrument 13 exceed the preselected limit, over-current protection circuit 52 will output a signal to gate 51. Gate 51 will change states causing power to be automatically removed in the sequence previously described. Turning "off" switch 35 will reset zero crossing and trigger assembly 34.

Figure 5:
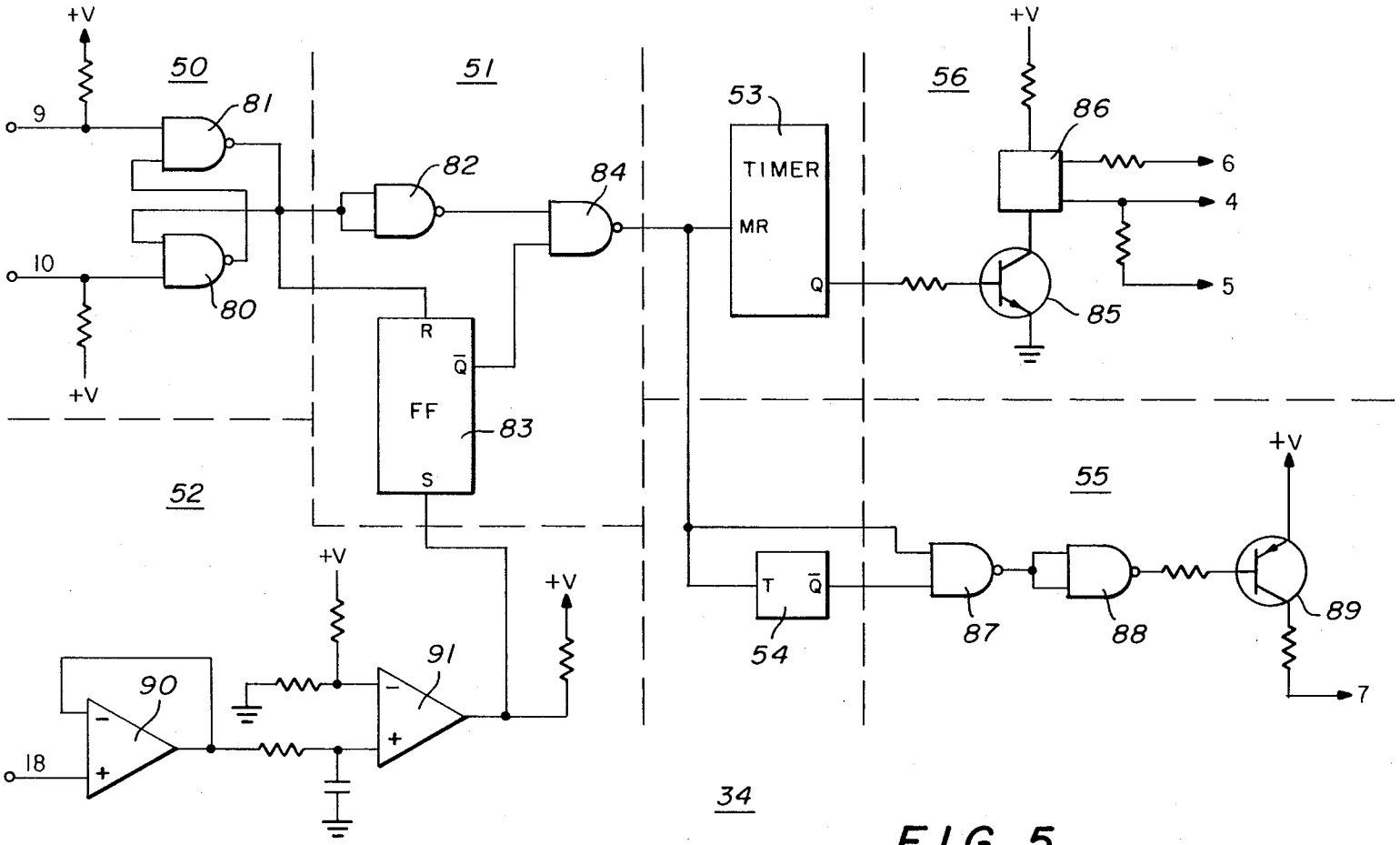
FIG. 5 is a circuit schematic diagram of the circuits illustrated in FIG. 3.

Referring now to FIG. 5, there is shown in schematic form a more detailed view of the circuits of zero crossing trigger assembly 34. Contact bounce eliminator 50 includes first and second NAND gates 80 and 81. Shifting switch 35 to an "on" position causes the output of gate 81 to shift low. This signal is coupled to both inputs of NAND gate 82 and the reset input of flip flop 83. The input signal shifting low on the inputs of gate 82 cause the output of shift high, further causing the output of NAND gate 84 to shift low. The shift low of the output of gate 84 is coupled to one input of NAND gate 87, causing the output to shift high, further causing the output of NAND gate 88 to shift turning on transistor 89, allowing current to flow through winding 38 of relay K1, thereby shifting the contact arm from terminal 45 to terminal 42.

The change in state of the output of gate 84 is also coupled to the MR input of timer 53 causing the Q output to shift high after a delay of a preselected time where it is latched until the counter is reset. The Q output shifting high allows transistor 85 to conduct enabling zero voltage crossing/optically coupled driver circuit 86 allowing current to flow through the gate of triac 33, further allowing triac 33 to conduct on the next zero crossing. In the preferred embodiment, zero voltage crossing/optically coupled driver circuit 86 is a Motorola model number MOC3031.

Figure 6:
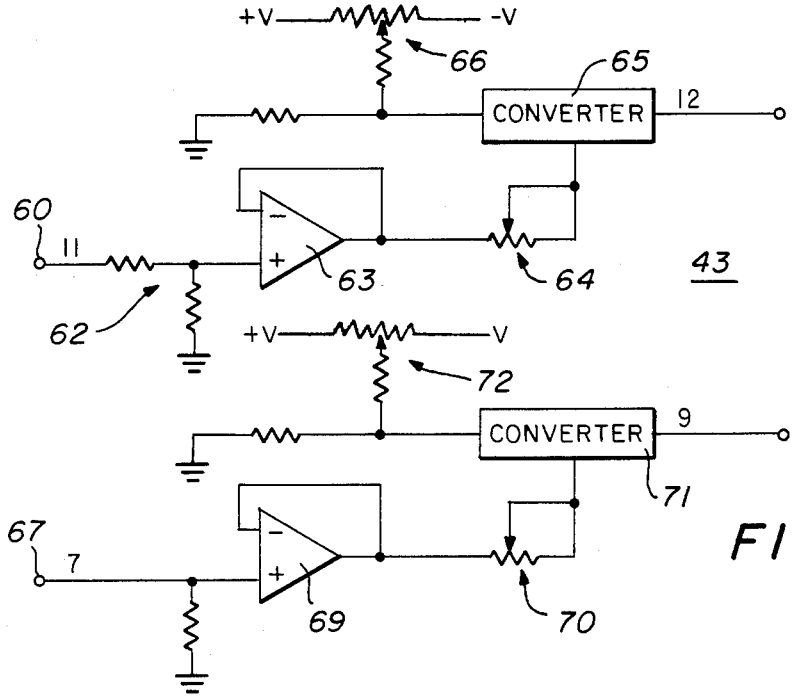
FIG. 6 is a circuit schematic diagram of the circuits illustrated in FIG. 4.

Referring now to FIG. 6, there is illustrated in schematic form the circuitry of RMS to DC converter assembly 43. A measurement proportional to the voltage across the secondary of transformer 30 is coupled through voltage divider network 62 into buffer 63. The output of buffer 63 is coupled into RMS to DC converter 65 for conversion to a DC signal for display on meter M1. Zero adjust network 66 and full scale adjust 64 establish the proper calibration scale for converter 65.

A measurement proportional to the current flow through transformer 41 is coupled through buffer 69 into RMS to DC converter 71. Zero adjust network 72 and full scale adjust 70 establish the proper calibration scale for converter 71. The output signal from converter 71 is coupled through buffer 90 (FIG. 5) into the positive input of comparator 91. The negative input of comparator 91 is set at a preselected voltage level representative of the maximum normal current flow to instrument 13. Should the actual current flow exceed the preselected limit, the output of comparator 91 will shift high causing the $\overline{Q}$ output of flip flop 83 to shift low gating out the input of gate 84 from gate 82. The output of gate 84 caused the $\overline{Q}$ output of timer 53 to reset causing transistor 85 to turn off resulting in triac 33 turning off on the next zero crossing. The output of gate 84 shifts high triggering multivibrator 54 resulting in a shift in output for a preselected time. This change of state holds on transistor 89 causing relay contact arm to maintain contact with terminal 42 for a period equal to the delay. Subsequently, transistor 89 turns off allowing the contact arm of relay K1 to shift to terminal 45.

Many modifications and variations besides those specifically mentioned may be made in the techniques and structures described herein and depicted in the accompanying drawings without departing substantially from the concepts of the present invention accordingly. It should be clearly understood that the form of the invention described and illustrated herein is exemplary only, and is not intended as a limitation on the scope of the present invention.

The embodiments of the invention in which an exclusive property or privilege is claimed are defined as follows:

1. Apparatus for providing full-wave alternating current power signals from a surface power source to an electric powered hydraulic system inductive load within a subsurface instrument suspended in a borehole by an electric wireline, comprising:

signal processing circuitry located at said earth's surface;

a power source of alternating current power signals located at said earth's surface;

first switching means for automatically switching said electric wireline from said signal processing circuitry and into electrical communication between said power source and said load;

second switching means for supplying said full-wave alternating current power signals to said load;

trigger means for automatically enabling said second switching means on a selected zero crossing of said power signals; and first delay means for enabling said trigger means after a preselected time delay from switching said wireline into electrical communication between said power source and said load, thereby enabling said trigger means on the next zero crossing of said power signals following said time delay and providing full-wave alternating current power signals to said load.

2. The apparatus for providing power signals of claim 1 wherein said second switching means further comprises a triac switch.

3. The apparatus for providing power signals of claim 2 wherein said trigger means further comprises:

a zero voltage crossing detector; and a triac driver connected between said zero voltage crossing detector and said triac switch.

4. The apparatus for providing power signals of claim 1 further comprising:

current monitoring means for measuring the current of said power signals supplied from said power source to said load;

comparison means for comparing said measured current to a preselected current limit;

means for automatically disabling said trigger means in response to said measured current exceeding said preselected limit thereby removing said power signals from said load on the subsequent zero crossing of said power signals; and second delay means for disabling said first switching means after a preselected time delay from said disabling of said trigger means for automatically decoupling said power source from said electric wireline and switching said wireline into electrical communication with said signal processing circuitry.

5. Apparatus for initiating full-wave alternating current power signals from a surface power source to an inductive load within a subsurface instrument suspended in a borehole by means of an electric wireline and minimizing interference from said initiating of power signals, comprising:

signal processing circuitry located at said earth's surface;

a power source of alternating current power signals located at said earth's surface;

first switch means for activating said power initiation;

second switch means responsive to said first switch means for automatically switching said electric wireline from said signal processing circuitry into electrical communication with said power source;

a triac switch for initiating full-wave alternating current power signals from said power source to said load;

zero crossing detector for triggering said triac switch means on a preselected zero crossing of said power signals;

delay means for delaying said triggering of said triac switch means by said zero crossing detector for a predetermined time duration after said switching of said electric wireline.

6. The apparatus of claim 5 wherein said second switch means further comprises:

an electric relay; and a relay trigger circuit responsive to said first switch means.

7. The apparatus of claim 6 wherein said delay means comprises a programmable timer responsive to said first switch means.

8. The apparatus of claim 7 wherein said zero crossing detector comprises:

a zero voltage crossing detector enabled in response to said programmable timer; and an optically coupled triac driver connected between said zero voltage crossing detector and said triac switch.

* * * * *